US007121643B2

(12) United States Patent
Yamada

(10) Patent No.: US 7,121,643 B2
(45) Date of Patent: Oct. 17, 2006

(54) INK-JET PRINTING HEAD

(75) Inventor: Takahiro Yamada, Toyoake (JP)

(73) Assignee: Brother Kogyo Kabushiki Kaisha, Tokyo (JP)

( * ) Notice: Subject to any disclaimer, the term of this patent is extended or adjusted under 35 U.S.C. 154(b) by 108 days.

(21) Appl. No.: 10/746,792

(22) Filed: Dec. 24, 2003

(65) Prior Publication Data

US 2004/0179057 A1 Sep. 16, 2004

(30) Foreign Application Priority Data

Mar. 10, 2003 (JP) ..... 2003-063634

(51) Int. Cl.
*B41J 2/15* (2006.01)
*B41J 2/14* (2006.01)

(52) U.S. Cl. ..... 347/20; 347/47

(58) Field of Classification Search ..... 347/20
See application file for complete search history.

(56) References Cited

U.S. PATENT DOCUMENTS

| | | | | |
|---|---|---|---|---|
| 6,209,982 | B1 * | 4/2001 | Nakamura | 347/30 |
| 6,945,636 | B1 * | 9/2005 | Sakaida et al. | 347/68 |
| 2003/0151645 | A1 * | 8/2003 | Yamada et al. | 347/47 |

FOREIGN PATENT DOCUMENTS

| | | |
|---|---|---|
| JP | 434 1851 | 11/1992 |
| JP | 3115755 | 6/1995 |
| JP | 3155416 | 6/1995 |
| JP | 8020107 | 1/1996 |
| JP | 11 348304 | 12/1999 |

* cited by examiner

*Primary Examiner*—Vip Patel
*Assistant Examiner*—Jannelle M. Lebrón
(74) *Attorney, Agent, or Firm*—Pitney Hardin LLP

(57) ABSTRACT

An ink-jet printing head including: a head unit which includes a plurality of nozzles from which inks of different kinds are ejected onto a recording medium and a plurality of ink supply ports from which the inks of different kinds are respectively supplied and which are open in a surface of the head unit, the plurality of ink supply ports being spaced apart form each other; and a joint member having a plurality of channels which are open in a surface of the joint member and which are spaced apart from each other, the joint member being connected at the surface thereof to the surface of the head unit, such that the plurality of channels communicate with the plurality of ink supply ports, respectively, and wherein at least one recess is formed on at least one of the surface of the head unit and the surface of the joint member such that each of the at least one recess is located at least one of between adjacent ones of the plurality of channels and between adjacent ones of the plurality of ink supply ports.

21 Claims, 7 Drawing Sheets

INK-JET PRINTING HEAD

The present application is based on Japanese Patent Application No. 2003-063634 filed on Mar. 10, 2003, the contents of which are incorporated herein by reference.

BACKGROUND OF THE INVENTION

1. Field of the Invention

The present invention relates in general to an ink-jet printing head of an ink-jet recording apparatus which ejects ink droplets onto a recording medium to form a desired image thereon.

2. Discussion of Related Art

An ink-jet printing head of an ink-jet recording apparatus such as an ink-jet printer is disclosed in JP-B2-3115755 (paragraphs [0016] through [0018] and FIGS. 1 and 2, in particular), for instance. The disclosed ink-jet printing head comprises a head unit which includes a plurality of nozzles or outlets (109) through which ink is ejected onto a recording medium, a plurality of ink passages communicating with the nozzles, and four ink chambers. The ink passages are divided into four groups each of which communicates with a corresponding one of the four ink chambers. Inks of four different colors are supplied, to the respective four ink chambers, from respective four ink supply conduits (620) which are held in communication with an external ink supply source, so that the ink-jet printing head performs a full-color printing operation.

Described in detail, the head unit of the disclosed ink-jet printing head includes a grooved plate (130) having a plurality of grooves which partially define the plurality of ink passages and four recesses which partially define the four ink chambers, and a heater board (100) having ink-ejection-energy generating elements which are aligned with the plurality of grooves formed in the plate (130). The grooved plate (130) and the heater board (100) are held in pressed contact with each other so as to define the plurality of ink passages and the four ink chambers. An ink supply member (600) having the four ink supply conduits (620) is connected to the head unit. On one of opposite surfaces of the plate 130 which is held in pressed contact with the heater board (100), there are formed separation grooves (113*a*–113*c*) each of which is located between adjacent two recesses. In other words, each separation groove is formed in a partition wall (111*a*–111*c*) between the adjacent two recesses. With the plate (130) and the heater board (100) being held in pressed contact with each other, a sealant is introduced from a sealant inlet provided on the ink supply member (600) into the separation grooves so that the separation grooves are filled with the sealant, for thereby separating the four ink chambers from one another.

Thus, the head unit of the disclosed ink-jet printing head is arranged to prevent undesirable mixing of inks of different colors between the adjacent two ink chambers in the head unit, owing to the partition walls each of which is formed between the adjacent two ink chambers. However, the above-indicated Publication does not provide any means to prevent mixing of inks of different colors which would take place between the four ink supply conduits (620) and the four ink chambers. There may be a possibility that the mixing of inks takes place not only inside the head unit but also outside the head unit.

SUMMARY OF THE INVENTION

It is therefore an object of the present invention to prevent mixing of inks of different kinds or colors from taking place outside a head unit of an ink-jet printing head, in particular, between the head unit and a joint member which is connected to a plurality of ink supply ports formed in the head unit.

The object indicated above may be achieved according to a principle of the present invention, which provides an ink-jet printing head comprising: a head unit which includes a plurality of nozzles from which inks of different kinds are ejected onto a recording medium and a plurality of ink supply ports from which the inks of different kinds are respectively supplied and which are open in a surface of the head unit, the plurality of ink supply ports being spaced apart form each other; and a joint member having a plurality of channels which are open in a surface of the joint member and which are spaced apart from each other, the joint member being connected at the surface thereof to the surface of the head unit, such that the plurality of channels communicate with the plurality of ink supply ports, respectively, and wherein at least one recess is formed on at least one of the surface of the head unit and the surface of the joint member such that each of the at east one recess is located at least one of between adjacent ones of the plurality of channels and between adjacent ones of the plurality of ink supply ports.

In the ink-jet printing head constructed as described above, the ink flowing through one of the plurality of channels or one of the plurality of ink supply ports is prevented from entering adjacent channels or adjacent ink supply ports due to a capillary force at the interface between the surface of the joint member and the surface of the head unit at which the joint member and the head unit are connected to each other, owing to the at least one recess formed in the surface of the head unit and/or the surface of the joint member such that each recess is located between adjacent ones of the channels and/or between adjacent ones of the ink supply ports.

In one preferred form of the present invention, the plurality of ink supply ports are formed at one of opposite ends of ink passages which are formed in the head unit and which communicate with the plurality of nozzles, the above-indicated one of the opposite ends being more distant from the plurality of nozzles than the other of the opposite ends, and the joint member includes a flange portion connected at one of opposite surfaces thereof to the surface of the head unit and a plurality of tubular portions formed on the other of the opposite surfaces of the flange portion, the plurality of channels extending through the respective tubular portions and the flange portion, the above-indicated each of the at least one recess being formed in the above-indicated one of the opposite surfaces of the flange portion.

In the above-described preferred form of the present invention, on one of the opposite surfaces of the flange portion of the joint member at which the joint member is connected to the head unit, at least one recess is formed such that each recess is located between adjacent ones of the plurality of channels. According to this arrangement, the ink flowing through one of the plurality of channels is prevented from entering adjacent channels due to the capillary force, owing to the recess formed as described above. Therefore, the inks of different kinds which flow through the respective channels are effectively prevented from mixing with each other even where the distance by which the plurality of channels are spaced apart from each other is relatively small, so that the distance by which the plurality of ink supply ports are spaced apart from each other can also be made small, for thereby advantageously reducing the sizes of the joint member and the head unit.

Preferably, the flange portion of the joint member is bonded, by an adhesive agent, at the surface thereof, to the surface of the head unit. Where the flange portion and the head unit are bonded together by using the adhesive agent, the joint member can be fixed to the head unit with high stability.

In still another preferred form of the present invention, the adhesive agent fills the above-indicated each of the at least one recess to form a partition wall between the adjacent ones of the channels, for isolating the adjacent ones of the channels from each other.

Where the flange portion is bonded to the head unit by using the adhesive agent, the adhesive agent enters or fills each recess which is formed so as to be located between the adjacent ones of the channels, and the adhesive agent solidifies in the recess. The adhesive agent which has solidified in the recess functions as a partition wall that separates or isolates the adjacent ones of the channels form each other. According to this arrangement, the ink flowing through one of the plurality of channels is prevented from entering adjacent channels owing to the partition wall of the adhesive agent described above, for thereby effectively preventing undesirable mixing of inks of different kinds which flow through the respective channels.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which:

FIG. 6A is an elevational view in cross section showing the joint member and the head unit before they are bonded to each other while

DETAILED DESCRIPTION OF THE PREFERRED EMBODIMENTS

Figure 1:
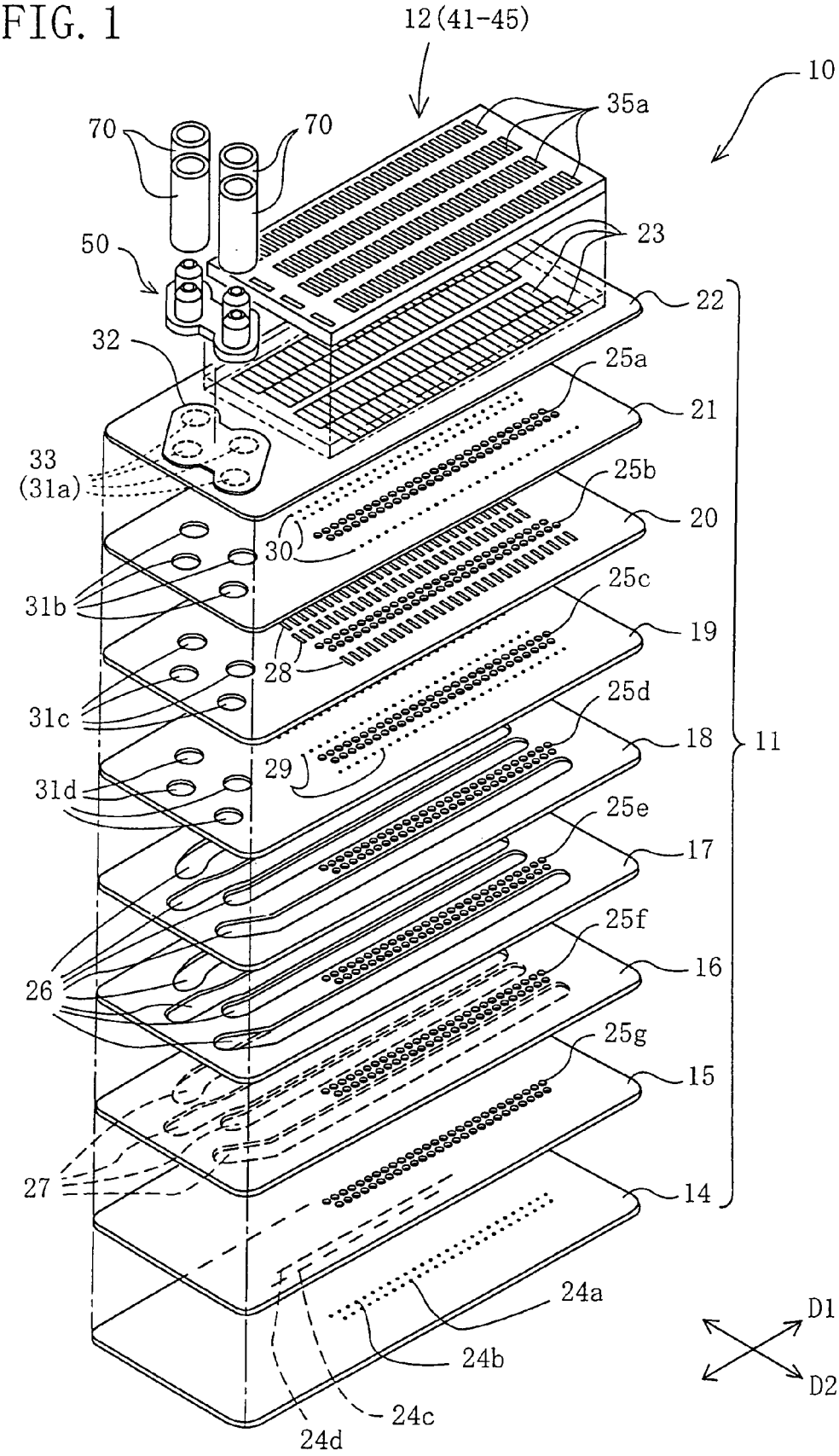
FIG. 1 is an exploded perspective view showing a head unit of an ink-jet printing head according to one embodiment of the present invention.

Referring first to FIG. 1, there is shown an ink-jet printing head 10 of a color ink-let printer constructed according to one embodiment of the present invention. The ink-jet printing head 10 includes a head unit 11 and an actuator unit 12 which is of a planar type. The actuator unit 12 is bonded to an upper surface of the head unit 11, namely, a metallic base plate 22 which will be described, and a flexible flat cable 13 for connection with an external device is superposed on and bonded by an adhesive agent to an upper surface of the actuator unit 12, as shown in FIG. 2.

As shown in FIG. 1, the head unit 11 is a laminar structure consisting of a total of nine relatively thin plates superposed on each other and bonded together by an adhesive agent. The nine thin plates consist of a nozzle plate 14, an intermediate plate 15, a damper plate 16, two manifold plates 17, 18, three (i.e., first through third) spacer plates, 19, 20, 21, and the above-indicated base plate 22.

In the present embodiment, the nozzle plate 14 is formed of a synthetic resin while the other plates 15–22 are formed from plates of a steel alloy including 42% of nickel and have thickness values of about 50–150 μm.

The nozzle plate 14 has nozzles 24 which are formed through the thickness thereof and from which inks of different kinds or colors are jetted. Each of the nozzles 24 has an extremely small diameter (about 25 μm in the present embodiment). The nozzles 24 are arranged in four parallel rows formed so as to extend in a longitudinal direction of the head unit 11 (in a D1-axis direction indicated in FIG. 1), such that the nozzles 24*a* and 24*b* in the respective two adjacent rows are arranged in a zigzag pattern, while the nozzles 24*c* and 24*d* in the respective two other rows are also arranged in a zigzag pattern.

A plurality of pressure chambers 23 are arranged in four rows in the base plate 22, with the same spacing pitch as the nozzles 24 in the longitudinal direction of the head unit 11 (in the above-indicated D-1 axis direction), such that the pressure chambers 23 in the respective two adjacent rows are positioned relative to each other in a zigzag pattern, while the pressure chambers 23 in the respective two other adjacent rows are similarly positioned relative to each other in a zigzag pattern. Each of the pressure chambers 23 is elongate in a direction of width of the head unit 11 (in a D2-axis direction indicated in FIG. 1), and is formed through the thickness of the base plate 22. Each of the pressure chambers 23 is held in communication at one of its opposite longitudinal ends with the corresponding nozzle 24 through a corresponding one of communication passages 25 defined by through-holes 25*a*, 25*b*, 25*c*, 25*d*, 25*e*, 25*f*, and 25*g* which are respectively formed through the spacer plates 21, 20, 19, the manifold plates 18, 17, the damper plate 16, and the intermediate plate 15, which plates 21, 20, 19, 18, 17, 16, 15 are located between the base plate 22 and the nozzle plate 14. Each pressure chamber 23 is held in communication at the other longitudinal end with a manifold portion 26 partially defined by the manifold plates 17, 18.

The two manifold plates 17, 18 partially define the manifold portion 26 in the form of mutually independent four elongate manifold chambers 26 all of which extend in parallel with the rows of the nozzles 24 described above. As shown in FIG. 1, one of opposite longitudinal ends of each manifold chamber 26 extends in a direction away from the other longitudinal end, for communication with a corresponding one of four ink supply paths 31 (which will be described) connected to an external ink supply source not shown.

Each manifold chamber 26 is formed through the entire thickness-of-each of the manifold plates 17, 18, by laser machining, plasma jet machining or electrolytic etching, and is fluid-tightly closed at its upper and lower ends as seen in FIG. 1 by the first spacer plate 19 superposed on the manifold plate 18 and the damper plate 16 underlying the manifold plate 17.

The damper plate 16 has damper chambers 27 in the form of grooves formed in its lower surface by etching through a portion of its thickness. These damper chambers 27 have the same shape as the manifold chambers 26 as viewed in the plane of the damper plate 16. The reverse component of the pressure wave of the ink in each pressure chamber 23 generated upon operation of the actuator unit 12 is absorbed by an oscillating motion of a relatively thin bottom wall of the damper chamber 27 formed in the damper plate 16, so that a cross talk which would otherwise occur between the adjacent pressure chambers 23 can be prevented.

The second spacer plate 20 partially defines flow restrictors 28 formed in alignment with the respective pressure chambers 23. Each of the flow restrictors 28 has a shape as shown in FIG. 2B, as seen in the plane of the second spacer plate 20. Each flow restrictor 28 has a large area of ink flow at its longitudinal opposite end portions 28*a*, 28*b* and a comparatively small area of ink flow at its intermediate portion. Each flow restrictor 28 is elongate in the longitudinal direction of the corresponding pressure chamber 23. The flow restrictors 28 are fluid-tightly closed at their lower end by the first spacer plate 19 underlying the second spacer plate 20, and at their upper end by the third spacer plate 21 superposed on the second spacer plate. 20.

Figure 2A:
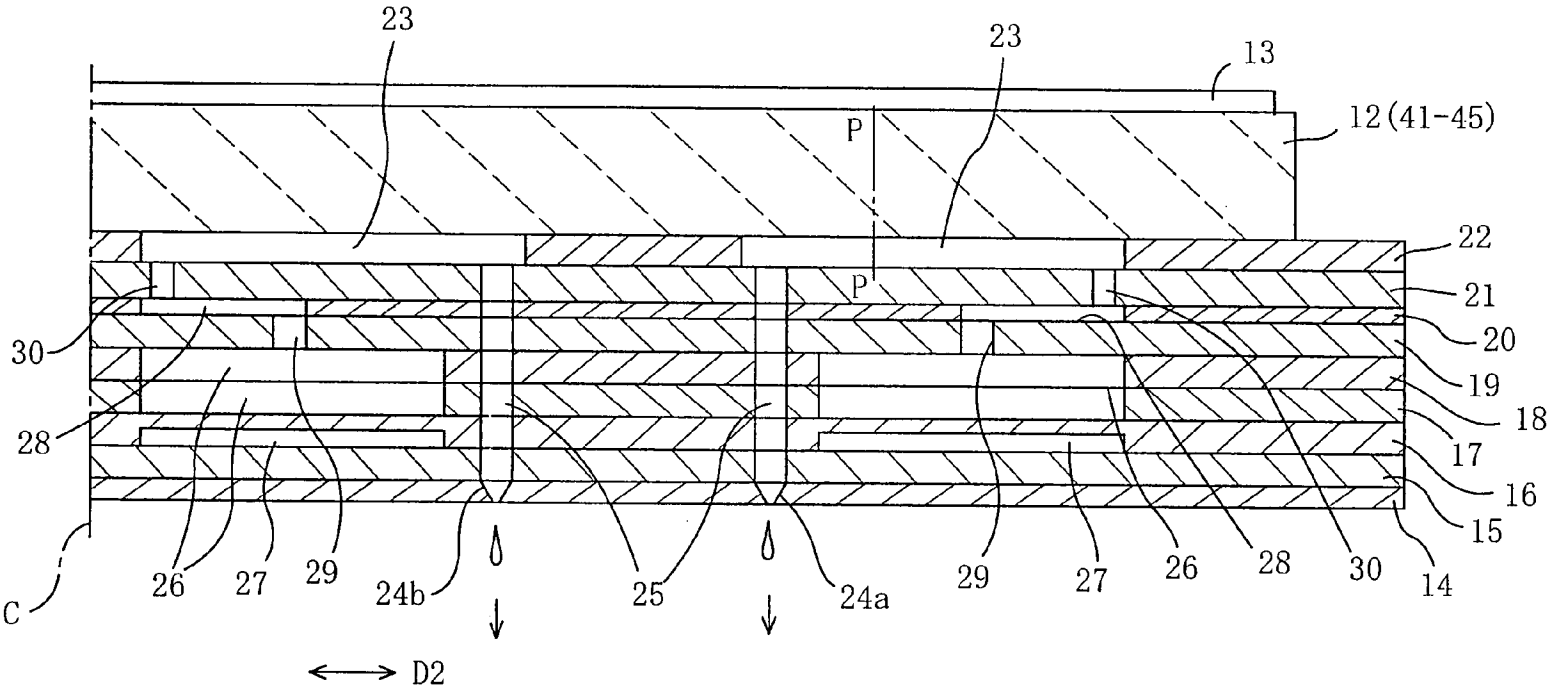
FIG. 2A is an elevational view in cross section taken in a plane parallel to a D2-axis direction indicated in FIG. 1, of a portion of a head unit, which portion is located on one of opposite sides of a lengthwise centerline C of the head unit.
Figure 2B:
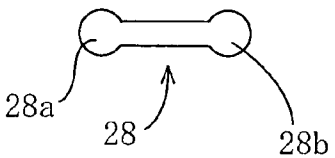
FIG. 2B is a plan view of each flow restrictor formed in a second spacer plate.

As shown in FIG. 2A, the first spacer plate 19 has first ink paths 29 communicating with the manifold chambers 26 and one longitudinal end portion 28*a* of each flow restrictor 28. The third spacer plate 21 has second ink paths 30 communicating with the other longitudinal end portion 28*b* of each flow restrictor 28 and the corresponding end portion of each pressure chamber 23.

Figure 4:
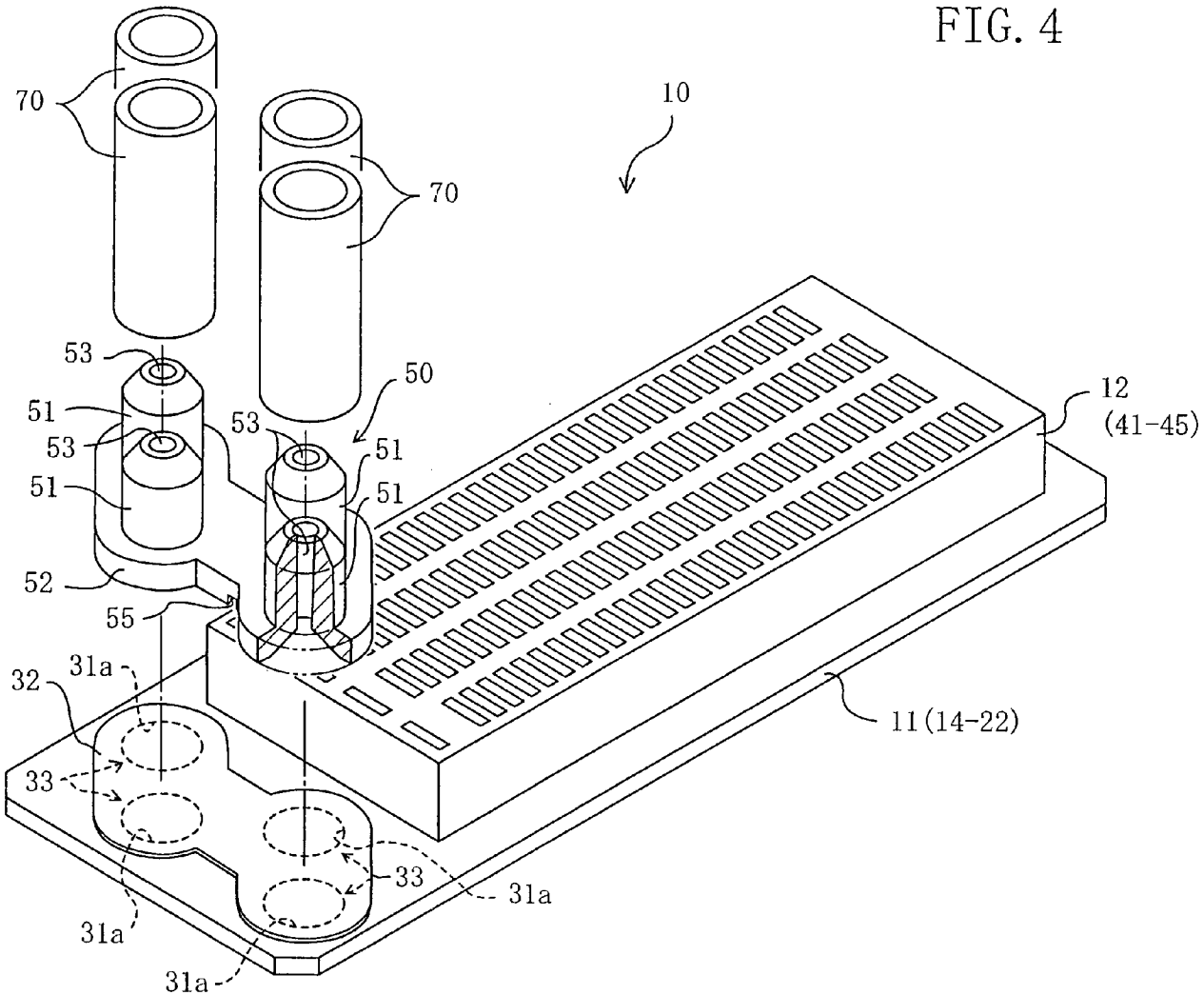
FIG. 4 is a perspective view showing a joint member to be fixed to the head unit and elastic tubes to be fitted on the respective tubular portions of the joint member.

As shown in FIG. 1, the base plate 22, and the third, second and first spacer plates 21, 20, 19 have respective ink supply holes 31*a*, 31*b*, 31*c*, 31*d* of a relatively large diameter formed through one of opposite longitudinal end portions of the respective plates 22, 21, 20, 19. These ink supply holes 31*a*–31*d* cooperate to define the four ink supply paths 31 described above. One of the opposite ends of the four ink supply paths 31 located on the side of the base plate 22 is open in one of the opposite surfaces of the head unit 11, which surface does not face the recording medium in the printing operation. Thus, there are provided four ink supply ports 33 at one of longitudinal opposite end portions of the above-indicated surface of the head unit 11, as shown in FIGS. 1 and 4. The other of the opposite ends of the ink supply paths 31 located on the side of the first spacer plate 19 are held in communication with the above-indicated one of longitudinal opposite end portions of the respective manifold chambers 26. The four ink supply ports 33 respectively correspond to the four rows of pressure chambers 23. One of the four ink supply ports 33 corresponding to one of adjacent two rows of pressure chambers and another of the four ink supply ports 33 corresponding to the other of the adjacent two rows are located at respective different longitudinal positions of the surface of the head unit. More specifically, the four ink supply ports 33 are arranged in two rows in a zigzag pattern, such that each ink supply port of one row is interposed between adjacent two ink supply ports of the other row.

As described above, the four ink supply ports 33 are open in the above-indicated surface of the head unit 11 shown in FIGS. 1 and 4. To the four ink supply ports 33, there are respectively supplied inks of four different colors, typically, yellow, magenta, cyan and black.

A thin plate-like filter 32 is provided to cover the upper surface of one of the opposite longitudinal end portions of the base plate 22 in which the four ink supply holes 31*a* are open. The filter 32 is provided for the purpose of removing dirt or any foreign matter that may be contained in the ink supplied form the ink supply source such as an ink reservoir. The filter 32 is produced by electroforming and has minute pores (not shown) at local portions thereof corresponding to the four ink supply holes 31*a*.

A joint member 50 is fixed to the upper surface of the filter 32 by an adhesive agent. The joint member 50 is used for introducing the ink supplied from the ink supply source not shown into the head unit 11. A detailed description of the joint member 50 will be given later.

Figure 3:
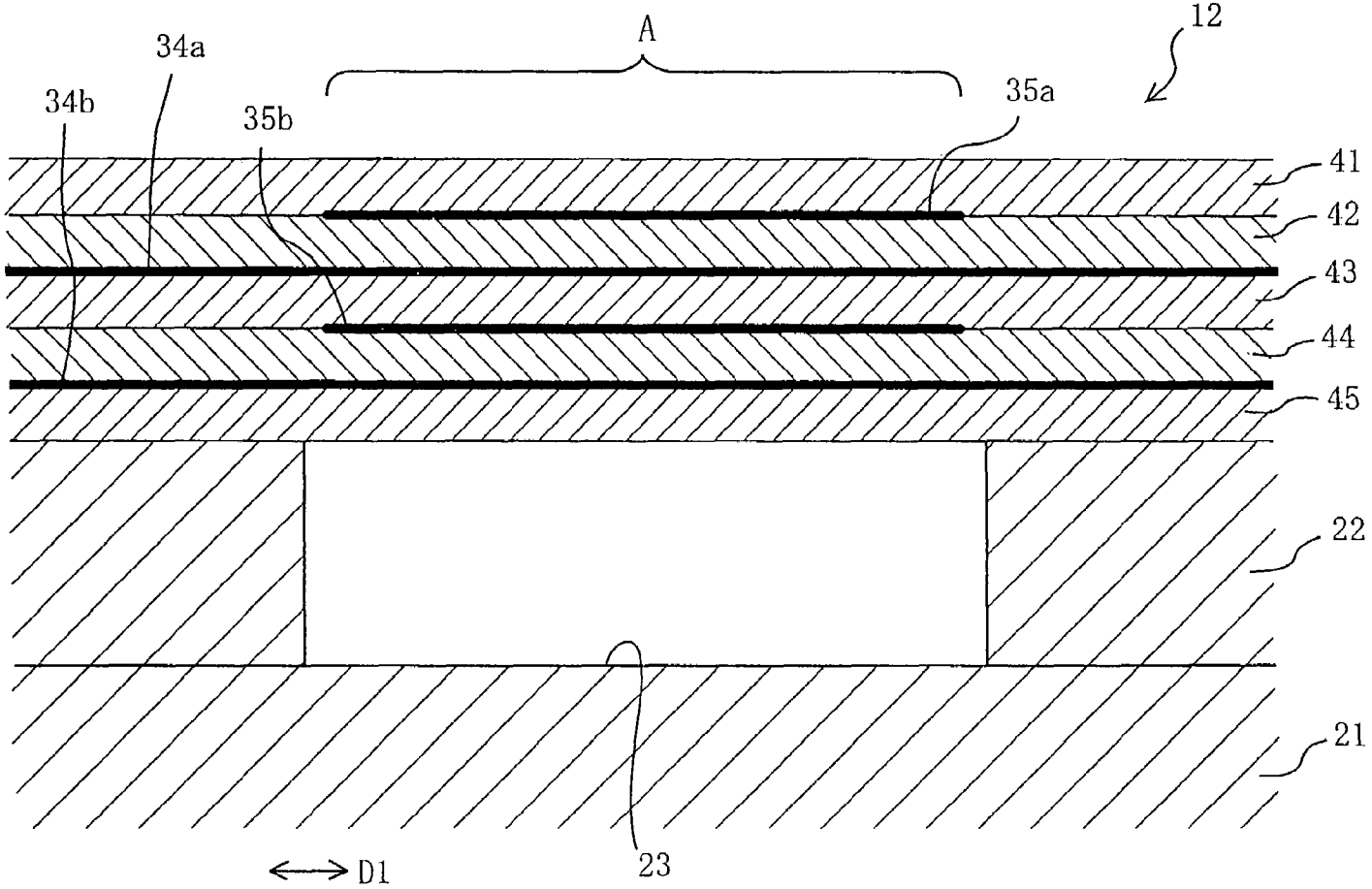
FIG. 3 is a fragmentary enlarged elevational view in cross section of an actuator unit of the ink-jet printing head of FIG. 1.

Referring next to FIG. 3 which is an enlarged elevational view in cross section taken along line P—P in FIG. 2A, there will be described the structure of the actuator unit 12. The actuator unit 12 is a laminar structure consisting of five piezoelectric sheets 41, 42, 43, 44, 45 each having a thickness value of about 30 μm. The actuator unit 12 is disposed on the head unit 11 so as to cover the plurality of pressure chambers 23. Each of the piezoelectric sheets 41–45 is formed of a ceramic material of lead zirconium titanate (PZT) which exhibits ferro electricity.

The structure of the actuator unit 12 is similar to that disclosed in JP-A-4-341851. Individual electrodes 35*a*, 35*b* and common electrodes 34*a*, 34*b* are alternatively interposed between the adjacent two piezoelectric sheets such that the individual electrodes 35*a*, 35*b* are aligned with the respective pressure chambers 23 and such that the common electrodes 34*a*, 34*b* cover the four rows of the pressure chambers 23. Portions of the piezoelectric sheets 41–45 which are sandwiched between the individual electrodes (35*a*, 35*b*) and the common electrodes (34*a*, 34*b*) are subjected to a polarization treatment in the direction of lamination of the piezoelectric sheets, so that the portions function as pressure generating portions (one of which is indicated by "A" in FIG. 3). When a voltage is applied between the selected individual electrodes and the common electrodes through a flexible flat cable 13 (FIG. 2A) superposed on the upper surface of the actuator unit 12, the corresponding pressure generating portion A is deformed in a direction that permits the volume the corresponding pressure chamber 23 to be changed. As a result, the ink in the pressure chamber 23 is ejected from the corresponding nozzle 24.

In the ink-jet printing head 10 constructed as described above, the inks of four different colors supplied from the respective four ink supply ports 33 are fed into the respective four manifold chambers 26 through the respective four ink supply paths 31 (each of which is defined by the ink supply holes 31*a*–31*d*), distributed into the respective four rows of pressure chambers 23 through the first ink paths 29, the restrictors 28, and the second ink paths 30. Upon operation of the actuator unit 12, the pressurized inks of four different colors are ejected from the respective four rows of nozzles 24 through the communication passages 25 to the recording medium. Thus, there are formed the ink passages in the head unit 11.

There will be next described the structure of the joint member 50. The joint member 50 includes a single plate-like flange portion 52 which is to be connected at one of opposite surfaces thereof to the head unit 11 and four tubular portions 51 formed on the other of the opposite surfaces of the flange portion 52 so as to extend therefrom. (The above-indicated one surface of the flange portion which is connected to the head unit 11 is hereinafter referred to as a "connecting surface".) The joint member 50 is fixed to one of the opposite surface of the head unit 11 (the upper surface thereof), such that the flange portion 52 of the joint member 50 is bonded, by an adhesive agent such as an epoxy adhesive agent, at the connecting surface thereof to the filter 32 which is fixed to the head unit 11, and such that the four tubular portions 51 are aligned with the respective four ink supply ports 33, as viewed in a direction perpendicular to the above-indicated one of the opposite surfaces of the head unit 11.

Each of the four tubular portions 51 has a channel 53 which communicates with a corresponding one of the ink supply ports 33. The channel 53 extends through the corresponding tubular portion 51 and the flange portion 52 such that one of opposite ends thereof is open at one of opposite ends of the tubular portion 51 remote from the flange portion 52 and the other end is open in the connecting surface of the flange portion 52.

In the joint member 50 wherein the four tubular portions 51 extend from the single flange portion 52, the four channels 53 can be arranged in a relatively narrow space, as compared with an arrangement wherein four individual or separate joint members each of which has a single flange portion and a single tubular portion are arranged on the head unit 11. Accordingly, the joint member 50 constructed as described above contributes to a reduction in the size of the head unit 11. In addition, the joint member 50 can be bonded to the head unit 11 (to the filter 32 in the present embodiment) with improved stability.

An elastic tube 70 is fitted at its one of opposite axial ends on the outer circumferential surface of each tubular portion 51 of the joint member 50. The elastic tube 70 has a cylindrical shape and is formed of a rubber materials for instance. The elastic tube 70 is connected at the other axial end to the ink supply source not shown.

Figure 5:
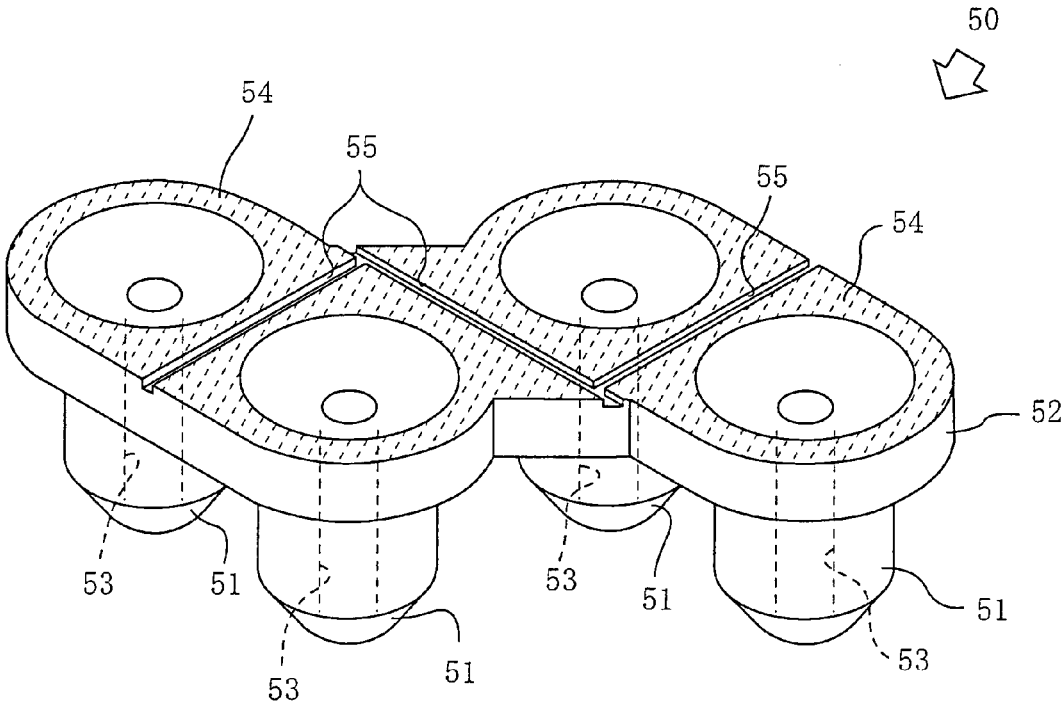
FIG. 5 is a perspective view showing the joint member with its connecting surface facing upward, which connecting surface is connected to the head unit.

FIG. 5 shows the joint member 50 with the connecting surface of the flange portion 52 facing upward. As shown in FIG. 5, the connecting surface of the flange portion 52 includes a bonding area 54 that surrounds the openings of the respective channels 53. The bonding area 54 corresponds to a hatched area shown in FIG. 5.

On the filter 32, there is provided an adhesive layer of an epoxy type, for instance, by a suitable method such as a transfer method, such that the adhesive layer corresponds to the bonding area 54 of the flange portion 52. With the joint member 50 being suitably positioned with respect to the filter 32, the flange portion 52 of the joint member 50 is pressed onto the filter 32, so that the joint member 50 is bonded to the head unit 11 via the filter 32.

As shown in FIG. 5, in the connecting surface of the flange portion 52 (more specifically the bonding area 54), there are formed recesses in the form of grooves 55 such that each groove 55 is located between the openings of the adjacent two channels 53.

Figure 6A:
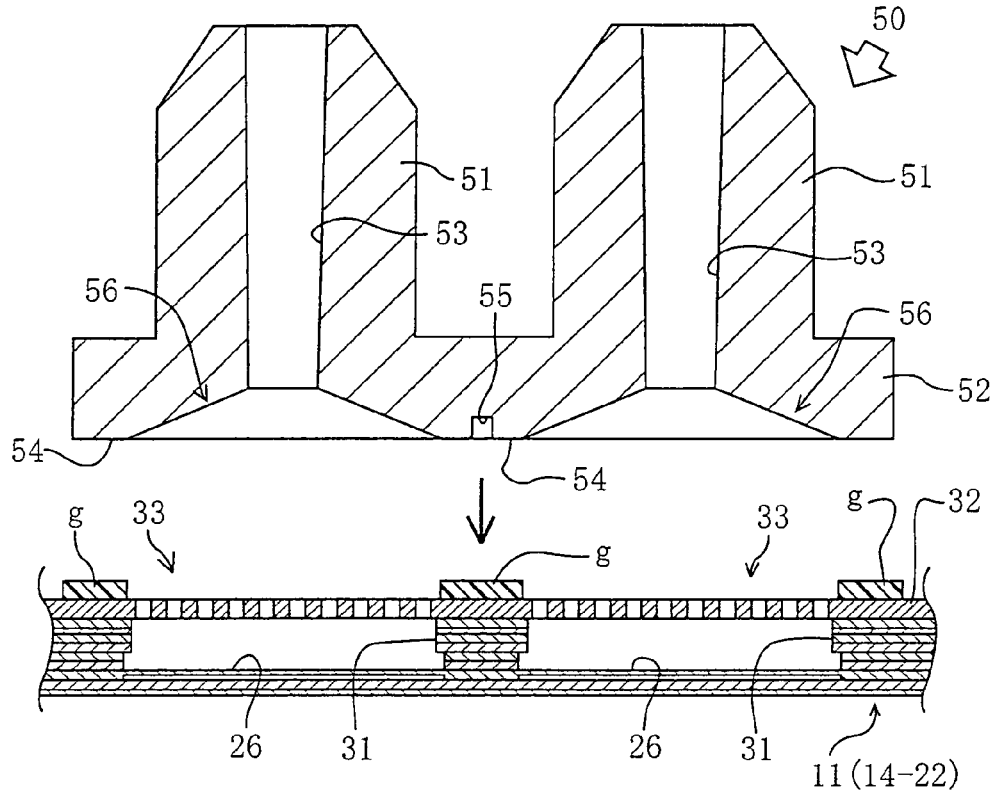
Figure 6B:
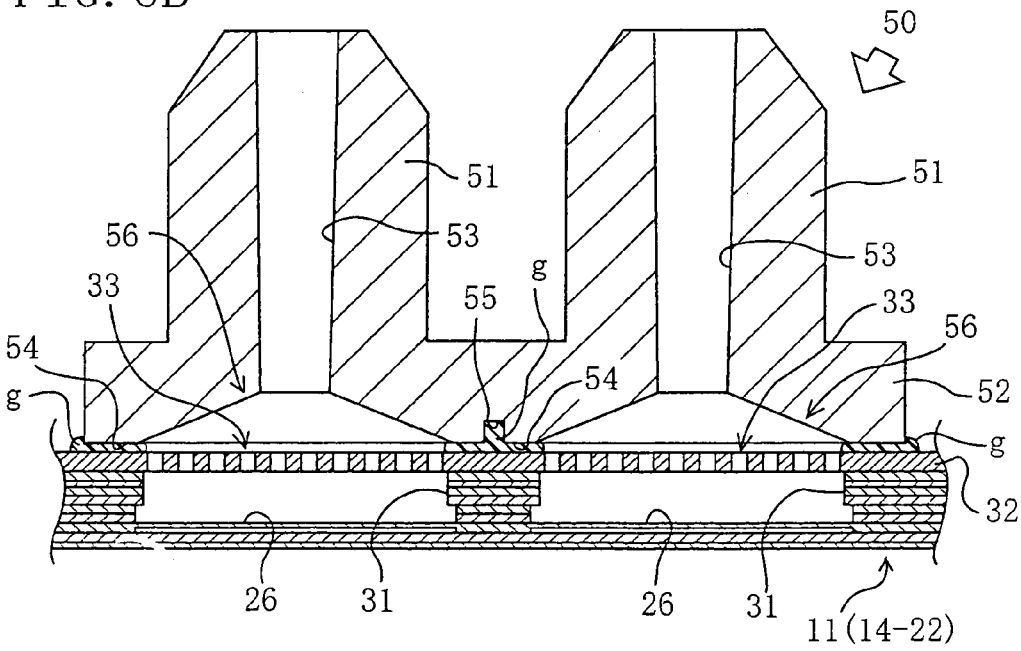
FIG. 6B is an elevational view in cross section showing the joint member and the head unit which are bonded to each other with a groove being filled with an adhesive agent.

The advantages of provision of the grooves 55 will be explained by referring to FIGS. 6A and 6B. As shown in FIG. 6A, the adhesive agent (adhesive layer) indicated by "g" in FIG. 6A is provided on the filter 32 such that the adhesive agent covers a part of the filter 32 corresponding to the bonding area 54 and the grooves 55 of the flange portion 52. When the flange portion 52 of the joint member 50 is pressed onto the filter 32, the adhesive agent flows into the grooves 55 owing its fluidity, for thereby filling the grooves 55 as shown in FIG. 6B.

Since each of the grooves 55 is formed so as to be located between the openings of the adjacent two channels 53 of the respective two tubular portions 51, the adhesive layer which has solidified in each groove 55 functions as a partition wall which separates or isolates the adjacent two channels 53 from each other.

According to this arrangement, the ink of one specific color which is supplied from the ink supply source and flows into one of the four channels 53 is prevented from entering the adjacent channel 53 through a small spacing or clearance between the flange portion 52 and the filter 32, in other words, through an interface between the connecting surface of the flange portion 52 and the adhesive layer, owing to the partition wall of the adhesive agent filling the groove 55 located between the adjacent two channels 53. Even where the joint member 50 has the single flange portion 52 according to the present embodiment, the plurality of channels 53 of the respective tubular portions 51 can be effectively isolated or separated from each other owing to the grooves 55 formed as described above. Accordingly, where the inks of four different colors flow through the respective four channels 53 in the present embodiment, the inks of different colors are advantageously prevented from mixing with each other.

In the present embodiment, each of the grooves 55 extends in a direction which intersects a straight line that connects the centers of the adjacent two channels 53, and the groove 55 has opposite ends which reach a peripheral edge of the flange portion 52, as shown in FIG. 5. According to this arrangement, when the joint member 50 is bonded to the head unit 11, the air existing between the head unit 11 and the joint member 50 is effectively discharged through the opposite ends of the groove 55, so that the air is less likely to remain between the head unit 11 and the joint member 50 in a state in which they are bonded together. Further, the adhesive agent fills the entirety of the groove 55, so that the partition wall of the adhesive agent continuously extends between the opposite ends of the groove 55 and has an elongate shape corresponding to the groove 55, without any discontinuity. Therefore, the inks of different colors in the respective channels 53 can be further advantageously prevented from mixing with each other.

As shown in FIGS. 6A and 6B, each channel 53 of the tubular portion 51 of the joint member 50 of the present embodiment includes a recessed portion which is formed at one of the axially opposite open end portions of the channel 53 at which the channel 53 is connected to the corresponding one of the ink supply ports 33 and which has an internal dimension as measured in a direction perpendicular to a direction of extension of the channel 53, the internal dimension increasing in the direction of extension from the other of the axially opposite open end portion of the channel 53 toward the one of the axially opposite open end portions. The internal dimension of the recessed portion may increase continuously or in steps in that direction. In the present embodiment, the recessed portion takes the form of a tapered portion 56 having a diameter which gradually increases in the direction of extension of the channel 53 from the other of the axially opposite open end portion of the channel 53 remote from the filter 32 toward the one of the axially opposite open end portions near the filter 32. According to this arrangement, the channel 53 has a larger cross sectional area at the tapered portion 56 than a portion thereof other than the tapered portion 56, so that a resistance to the flow of the ink passing through the filter 32 is reduced. The filter 32 provided between the joint member 50 and the head unit 11 for removing dirt or any foreign matter generally causes an increase in the ink flow resistance. In the present arrangement, however, an increase in the pressure of the ink which would be otherwise caused when the ink passes through the filter 32 is prevented or minimized owing to the tapered portion 56. Accordingly, the pressure of the ink is relatively low at the connected portion between the joint member 50 and the head unit 11, for thereby advantageously preventing the ink in one of the channels 53 from entering the adjacent channels 53.

Figure 7:
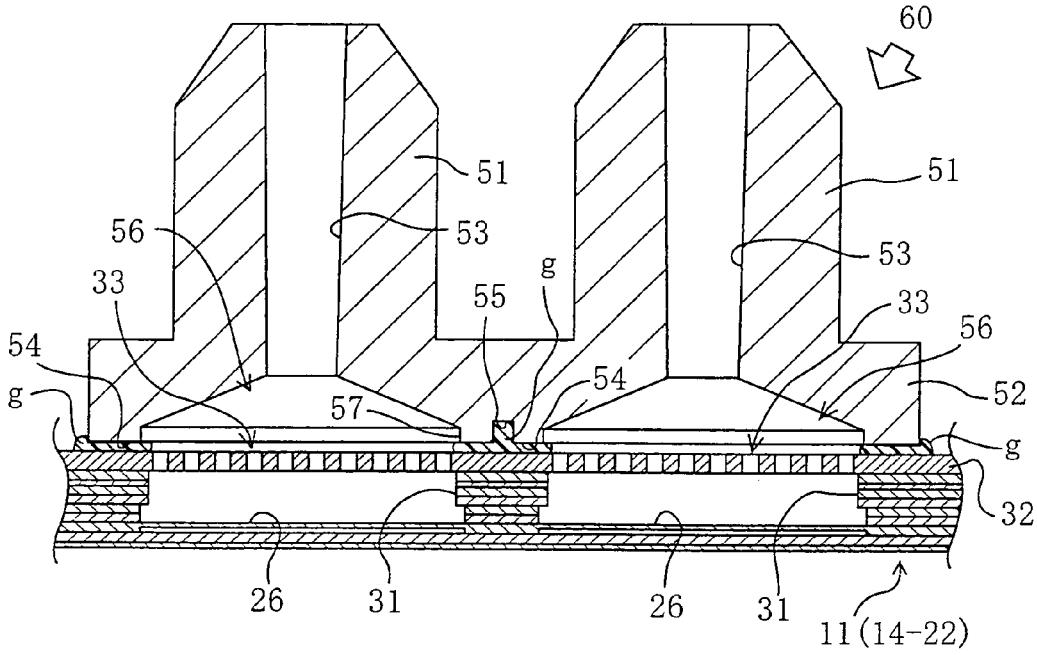
FIG. 7 is an elevational view in cross section showing a joint member according to another embodiment of the invention and the head unit which are bonded to each other.

Referring next to FIG. 7, there is shown a joint member 60 constructed according to another embodiment of the present invention. The joint member 60 in this second embodiment differs from the joint member 50 in the illustrated first embodiment in that each channel 53 of the tubular portion 51 of the joint member 60 includes a straight portion 57 having a constant internal dimension over an entire axial length thereof and formed at one of opposite axial ends of the tapered portion 56 which is located on the side of the filter 32.

In the joint member 50 of the illustrated first embodiment wherein each of the channels 53 includes only the tapered portion 56 at one of its axially opposite open end portions, the adhesive agent tends to easily enter a wedge-shaped clearance formed at the peripheral portion of the tapered portion 56, due to the capillary force. In this case, the adhesive agent entered the tapered portion 56 may undesirably disturb smooth flow of the ink. In particular where the viscosity of the adhesive agent is relatively low, the adhesive agent is likely to enter the tapered portion 56. In the joint member 60 constructed according to the second embodiment, however, the adhesive agent is prevented from entering the tapered portion 56 due to the capillary force, owing to the provision of the straight portion 57 formed as described above. Accordingly, the joint member 60 whose channels 53 include the straight portions 57 assures smooth flow of the ink from the ink supply source into the head unit 11.

In the illustrated embodiments, the tapered portion 56 or the straight portion 57 preferably has, at an open end thereof at which the tapered portion 56 or the straight portion 57 is connected to the corresponding ink supply port 33, an internal dimension as measured in the direction perpendicular to the direction of extension of the channel 53, the internal dimension being substantially equal to an internal dimension of the ink supply port 33 as measured in a plane parallel to the surface of the head unit 11 in which the ink supply ports 33 are open.

In the ink-jet printing head described above, while it is desirable that the center of each channel 53 and the center of each ink supply port 33 are preferably aligned with each other, the centers of the channel and the ink supply port may be offset from each other, as needed. In this case, however, where the opening of the channel and the opening of the ink supply port at which the channel and the ink supply port are connected to each other for fluid communication therebetween have dimensions different from each other as measured in a direction perpendicular to the axial direction of the channel and the ink supply port, the opening of one of the channel and the ink supply port, which opening has a smaller dimension than the opening of the other of the channel and the ink supply port, is preferably located or positioned within the opening of the other of the channel and the ink supply port which has a larger dimension, as seen in the axial direction. Further, where one of the channel and the ink supply port has the recessed portion which has a larger cross sectional area than the other portion thereof and at which the above-indicated one of the channel and the ink supply port is connected to the other of the channel and the ink supply port, the centers of the channel and the ink supply port may be easily offset from each other since the centers of the larger cross sectional area and the above-indicated other portion may be offset from each other.

While the preferred embodiments of the present invention have been described above, for illustrative purpose only, it is to be understood that the invention is not limited to the details of the illustrated embodiments, but may be embodied with various changes, modifications and improvements, which may occur to those skilled in the art, without departing from the spirit and scope of the invention defined in the attached claims.

For instance, while the joint member 50, 60 is bonded to the filter 32 in the illustrated first and second embodiments, the joint member 50, 60 may be bonded at its flange portion 52 directly to the head unit 11.

The joint member 50, 60 of the illustrated embodiments has the single flange portion 52 and the four tubular portions 51 which extend from the flange portion 52. The number of the tubular portions 51 is not particularly limited, provided that joint member has at least two tubular portions. For instance, the joint member may have two tubular portions, three tubular portions or five or more tubular portions. The shape of each tubular portion 51 is not limited to the cylindrical shape shown in FIG. 5. For instance, the tubular portion may have a polygonal shape in transverse cross section.

Each recess formed in the flange portion 52 of the joint member 50, 60 is not limited to the elongate groove 55 described above. The recess may be a circular recess, preferably an elongate recess extending in a direction which intersects the straight line that connects the centers of the adjacent two channels 53, preferably in a direction perpendicular to the straight line. Where the recess takes the form of the groove 55 described in the illustrated embodiments, the adhesive agent which fills the entirety of the groove 55 functions as the partition wall which continuously extends between the opposite ends of the groove 55, for thereby effectively preventing the ink flowing through one of the channels 53 from entering the adjacent channels 53.

In the illustrated embodiments, the recessed portion formed at the one of the axially opposite open end portions of each channel 53 takes the form of the tapered portion 56 which is defined by a part-conical surface. The tapered portion 56 may be defined by a part-pyramidal surface. Further, the recessed portion may be otherwise formed, as long as it has a configuration whose cross sectional area increases continuously or in steps in the direction of extension of the channel 53 from the other of the axially opposite open end portion of the channel 53 remote from the filter 32 toward the one of the axially opposite open end portions near the filter 32. For instance, unlike the tapered portion 56 whose internal dimension as measured in the direction perpendicular to the direction of extension of the channel 53 linearly increases in the direction of extension from the other of the axially opposite open end portion of the channel 53 remote from the filter 32 toward the one of the axially opposite open end portions near the filter 32, the recessed portion may have the internal diameter which non-linearly increases. The channel 53 may have a stepped portion having an internal dimension which is larger than that of a portion thereof other than the stepped portion.

In the illustrated embodiments, the joint member 50 has the grooves 55 formed in the connecting surface of the flange portion 52. Where the joint member 50 is connected directly to the head unit 11, at least one of the joint member 50 and the head unit 11 has the grooves 55. Where the filter 32 is included in one of the joint member 50 and the head unit 11 as a part thereof, the grooves 55 may be formed in the filter 32 or the other of the joint member 50 and the head unit 11. Where the joint member 50 and the head unit 11 is connected to each other via the filter 32, at least one of the joint member 50, the head unit 11, and the filter 32 has the grooves.

What is claimed is:

1. An ink-jet printing head comprising:

a head unit which includes a plurality of nozzles from which inks of different kinds are ejected onto a recording medium and a plurality of ink supply ports from which said inks of different kinds are respectively supplied and which are open in a surface of said head unit, said plurality of ink supply ports being spaced apart from each other; and a joint member having a plurality of channels which are open in a suface of said joint member and which are spaced apart from each other, said joint member being connected at said suface thereof to said surface of said head unit, such that said plurality of channels communicte with said plurality of ink supply ports, respectively, wherein at least one recess is formed on at least one of said surface of said head unit and said surface of said joint member such that each of said at least one recess is located at least one of between adjacent ones of said plurality of channels and between adjacent ones of said plurality of ink supply ports, and wherein said plurality of ink supply ports are formed at one of opposite ends of ink passages which are formed in said head unit and which communicate with said plurality of nozzles, said one of the opposite ends being more distant from said plurality of nozzles than the other of the opposite ends, and said joint member includes a flange portion connected at one of opposite surfaces thereof to said surface of said head unit and a plurality of tubular portions formed on the other of the opposite surfaces of said flange portion, said plurality of channels extending through the respective tubular portions and said flange portion, said each of said at least one recess being formed in said one of the opposite surfaces of said flange portion.

2. The ink-jet printing head according to claim 1, wherein said head unit further includes a plurality of pressure chambers which are arranged in a longitudinal direction of said head unit, divided into a plurality of groups, and are open in said surface of said head unit, said plurality of ink supply ports being open in said surface of said head unit at one of opposite longitudinal end portions thereof, each of said plurality of groups of pressure chambers communicating with a corresponding one of said plurality of ink supply ports, each of said pressure chambers communicating with a corresponding one of said plurality of nozzles.

3. The ink-jet printing head according to claim 2, wherein said plurality of pressure chambers are arranged in a plurality of rows which respectively correspond to said plurality of ink supply ports, one of said plurality of ink supply ports corresponding to one of adjacent two rows of said plurality of rows of pressure chambers and another of said plurality of ink supply ports corresponding to the other of the adjacent two rows are located at respective different longitudinal positions of said surface of said head unit.

4. The ink-jet printing head according to claim 2, wherein said plurality of channels of said join member are respectively aligned with said plurality of ink supply ports as viewed in a direction perpendicular to said surface of said head unit.

5. The ink-jet printing head according to claim 1, wherein said plurality of ink supply ports consist of four ink supply ports, said plurality of channels of said joint member consists of four channels, and said inks of different kinds are inks of different four colors.

6. The ink-jet printing head according to claim 1, wherein said head unit further includes a plurality of pressure chambers which are arranged in a plurality of rows and a plurality of manifold chambers, said plurality of nozzles being arranged in a plurality of rows, said ink passages communicating respectively with said plurality of rows of nozzles through said plurality of ink supply ports and said plurality of manifold chambers, one of said inks of different kinds being supplied into a corresponding one of said plurality of rows of pressure chambers via a corresponding one of said plurality of tubular portions of said joint member and ejected from a corresponding one of said plurality of rows of nozzles.

7. The ink-jet printing head according to claim 1, wherein each of said plurality of tubular portions of said joint member is connected to an elastic tube through which each of said inks of different kinds is supplied from an ink supply source provided outside said ink-jet printing head.

8. The ink-jet printing head according to claim 1, wherein said join member is bonded, by an adhesive agent, at said surface thereof, to said surface of said head unit.

9. The ink-jet printing head according to claim 8, wherein said adhesive agent fills said each of said at least one recess to form a partition wall between said adjacent ones of said channels, for isolating said adjacent ones of said channels from each other.

10. The ink-jet printing head according to claim 1, wherein said each of said at least one recess is at least one groove.

11. The ink-jet printing head according to claim 10, wherein said groove extends in a direction which intersects a straight line that connects centers of said adjacent ones of said channels.

12. The ink-jet printing head according to claim 11, wherein said groove has opposite ends which reach a peripheral edge of said joint member.

13. An ink-jet printing head comprising:

a head unit which includes a plurality of nozzles from which inks of different kinds are ejected onto a recording medium and a plurality of ink supply ports from which said inks of different kinds are respectively supplied and which are open in a surface of said head unit, said plurality of ink supply ports being spaced apart from each other; and a joint member having a plurality of channels which are open in a surface of said joint member and which are spaced apart form each other, said joint member being connected at said surface thereof to said surface of said head unit, such that said plurality of channels communicate with said plurality of ink supply ports, respectively, wherein at least one recess is formed on at least one of said surface of said head unit and said surface of said joint member such that each of said at least one recess is located at least one of between adjacent ones of said plurality of channels and between adjacent ones of said plurality of ink supply ports, wherein said joint member is bonded, by an adhesive agent, at said surface thereof, to said surface of said head unit, and wherein said adhesive agent fills said each of said at least one recess to form a partition wall between said adjacent ones of said channels, for isolating said adjacent ones of said channels from each other.

14. The ink-jet printing head according to claim 13, wherein said each of said at least one recess is at least one groove.

15. The ink-jet printing head according to claim 14, wherein said groove extends in a direction which intersects a straight line that connects centers of said adjacent ones of said channels.

16. The ink-jet printing head according to claim 15, wherein said groove has opposite ends which reach a peripheral edge of said joint member.

17. An ink-jet printing head comprising:

a head unit which includes a plurality of nozzles from which inks of different kinds are ejected onto a recording medium and a plurality of ink supply ports from which said inks of different kinds are respectively supplied and which are open in a surface of said head unit, said plurality of ink supply ports being spaced apart from each other; and a joint member having a plurality of channels which are open in a surface of said joint member and which are spaced apart from each other, said joint member being connected at said surface thereof to said surface of said head unit, such that said plurality of channels communicate with said plurality of ink supply ports, respectively, wherein at least one recess is formed on at least one of said surface of said head unit and said surface of said joint member such that each of said at least one recess is located at least one of between adjacent ones of said plurality of channels and between adjacent ones of said plurality of ink supply ports, and wherein the ink-jet printing head further comprises a filter fixed to said head unit so as to cover said plurality of ink supply ports, said joint member being connected to said head unit via said filter, and wherein each of said channels has a larger cross sectional area at one of axially opposite open end portions thereof which is located on the side of said filter, than a portion thereof other than said one of the axially opposite open end portions.

18. The ink-jet printing head according to claim 17, wherein said one of the axially opposite open end portions of said each of said channels includes a recessed portion having an internal dimension as measured in a direction perpendicular to a direction of extension of said each of said channels, said internal dimension increasing in said direction of extension from the other of the axially opposite open end portions toward said one of the axially opposite open end portions.

19. The ink-jet printing head according to claim 18, wherein said internal dimension of said recessed portion continuously increases in said direction of extension of said each of said channels from the other of the axially opposite open end portions toward said one of the axially opposite open end portions.

20. The ink-jet printing head according to claim 19, wherein said one of the axially opposite open end portions further includes a straight portion having a constant internal dimension over an entire axial length thereof, said straight portion being formed at one of opposite axial ends of said recessed portion which is located on the side of said filter.

21. The ink-jet printing head according to claim 17, wherein an internal dimension of said larger cross sectional area is substantially equal to an internal dimension of each of said plurality of ink supply ports as measured in a plane parallel to said surface of said head unit.

* * * * *